United States Patent [19]

Croset et al.

[11] Patent Number: 4,650,991

[45] Date of Patent: Mar. 17, 1987

[54] METHOD AND APPARATUS FOR SENSING SHEETS

[75] Inventors: Michael R. Croset; Martin Lane, both of Hampshire, England

[73] Assignee: De La Rue Systems Limited, London, England

[21] Appl. No.: 625,786

[22] Filed: Jun. 28, 1984

[30] Foreign Application Priority Data

Jul. 1, 1983 [GB] United Kingdom ..... 8317896
Jul. 26, 1983 [GB] United Kingdom ..... 8320149

[51] Int. Cl.[4] ..... G01B 11/06
[52] U.S. Cl. ..... 250/223 R; 356/381
[58] Field of Search ..... 356/381, 376; 364/563, 364/562; 250/560, 561, 223 R

[56] References Cited

U.S. PATENT DOCUMENTS 4,285,745 8/1981 Farabaugh ..... 356/381
4,491,929 1/1985 Ikoma et al. ..... 364/563

FOREIGN PATENT DOCUMENTS

WO81/01827 7/1981 PCT Int'l Appl. .
WO82/01698 5/1982 PCT Int'l Appl. .
2055766 3/1981 United Kingdom .
2059927 4/1981 United Kingdom .

*Primary Examiner*—David C. Nelms
*Assistant Examiner*—S. Allen
*Attorney, Agent, or Firm*—Cushman, Darby & Cushman

[57] ABSTRACT

Apparatus for sensing the passage of sheets (48) through a nip (24), comprises a pair of guide surfaces (20,27) defining the nip (24); means (17,20) for passing sheets (48) through the nip (24); and sensing means formed by pairs of light emitting diodes (37) and phototransistors (38) (37,38) for sensing the deflection of one guide surface relatively to the other. Monitoring means (41,42,43) are provided for monitoring the output of the sensing means (37,38) and for storing a guide surface profile corresponding to the sensing means output when no sheet (48) is present. Comparison means (44) compares subsequent test profiles generated by the monitoring means (41,42) with the stored profile; and detection means (42) detects the presence of a sheet in the nip (24) only when there is a substantially uniform difference between the stored and test profiles.

6 Claims, 5 Drawing Figures

METHOD AND APPARATUS FOR SENSING SHEETS

BACKGROUND OF THE INVENTION

The invention relates to a method and apparatus for sensing the passage of sheets through a nip between a pair of guide surfaces by sensing with sensing means the relative deflection between the guide surfaces in response to the presence of a sheet in the nip. Such methods and apparatus are hereinafter referred to as of the kind described.

One example of a method and apparatus of the kind described is illustrated in No. WO-A-82/01698. In this construction an expected thickness of a banknote is preset and a suitable signal is fed to an auto reference circuit which adds to the expected thickness a value representing a datum corresponding to a roller resting on a guide surface. Subsequently, when a note passes under the roller which is connected via an arm to a linear variable differential transformer, an output signal is fed to comparators which will determine whether or not a note is present. Between the passage of each note, the datum level is rechecked and a suitable correction is made by the auto reference circuit to the reference signals fed to the comparators.

One of the problems with methods and apparatus of the kind described is that the guide surfaces may not be truely uniform and indeed may vary during use. This is particularly the case where one of the surfaces is formed in a resilient material such as rubber. One of the main difficulties with this is that the degree of variation is often of the same order of magnitude as the thickness of a sheet such as a banknote. Furthermore the apparatus can be affected by dust.

SUMMARY OF THE INVENTION

In accordance with one aspect of the present invention, a method of the kind described comprises (a) monitoring 1 at a number of sampling times, the output of the sensing means when no sheet is present to generate and store a guide surface profile;

(b) monitoring subsequent output of the sensing means at a plurality of sampling times to form a test profile;

(c) comparing the test profile with the stored profile; and (d) sensing the presence of a sheet in the nip only when there is a substantially uniform difference between the test profile and the stored profile.

In accordance with a second aspect of the present invention, apparatus for sensing the passage of sheets through a nip comprises a pair of guide surfaces defining the nip; means for passing sheets through the nip; and sensing means for sensing the deflection of one guide surface relatively to the other; and is characterised by monitoring means for monitoring the output of the sensing means and for storing a guide surface profile corresponding to the sensing means output when no sheet is present; comparison means for comparing subsequent output of the sensing means with the stored profile; and detection means for detecting the presence of a sheet in the nip only when there is a substantially uniform difference between the subsequent output and the stored profile.

With this invention, instead of simply monitoring a single datum, a full profile of the guide surfaces is stored. Thus any variations in the form of the guide surfaces which could lead to erroneous deflections being sensed are compensated for by sensing the output of the sensing means for each repeated movement of the guide surfaces and comparing the output with the originally monitored profile when no sheet was present. This enables any eccentricity or non-linearity to be compensated for where a roller assembly is used.

Typically, the pair of guide surfaces can be provided by a pair of driven rollers or wheels but other arrangements are possible. Normally, one guide surface will be fixed relative to a housing while the other guide surface, will be urged towards the one guide surface and it is the movement or deflection of this guide surface which is monitored.

Preferably, the monitoring portion of step (a) is repeated at regular intervals and most preferably is carried out after the passage of each sheet. In practice it is sufficient to carry out step (a) after the passage of a batch of sheets. This enables variations in the guide surface profile occurring during use to be compensated for. Typically, the new guide surface profile generated will be stored in place of the previous stored profile but in some cases the two profiles could first be compared and the new profile stored only if a significant difference was detected.

Conveniently, the output of the sensing means is monitored at a number of equal spatial intervals in one pass of the guide surfaces, particularly forty intervals. We believe that effectively dividing the guide surface into forty sections of equal size is sufficient to provide a workable profile, but the number can be varied as appropriate.

In one example, the presence of a sheet in the nip may be sensed when the difference between the subsequent output and the stored profile exceeds a threshold. Preferably after the guide surface profile has been stored, the method comprises carrying out steps b–d with a relatively small threshold until the difference detected in steps c and d exceeds the threshold, generating a new threshold substantially equal to half the difference determined in steps c and d, and thereafter repeating steps b to d with the new threshold.

With this method, a relatively small threshold is initially set so that when sheets are fed through the apparatus the first sheet is detected when the sensing means output exceeds the threshold. This first threshold is set sufficiently small to detect a sheet but large enough so that the effect of dirt and dust on the guide surfaces is ignored. In the simplest case, it is assumed that the first sheet is fed correctly as a single sheet and the new threshold is set to be substantially equal to half the difference just determined. Thus subsequently only differences between the sensing means output and the stored profile exceeding this new threshold will be taken to indicate passage of a sheet. Preferably, the method further comprises determining whether the difference between the output of the sensing means and the stored profile is more than three times the new threshold. This condition may be taken to indicate when two or more sheets pass through the apparatus simultaneously or other unacceptable situations.

The method and apparatus have particular application to banknote feeding apparatus such as banknote counting and sorting apparatus.

BRIEF DESCRIPTION OF THE DRAWINGS

An example of banknote counting apparatus for carrying out a method in accordance with the invention will now be described with reference to the accompanying drawings, in which:-

DETAILED DESCRIPTION OF THE PRESENTLY PREFERRED EXEMPLARY EMBODIMENT

Figure 1:
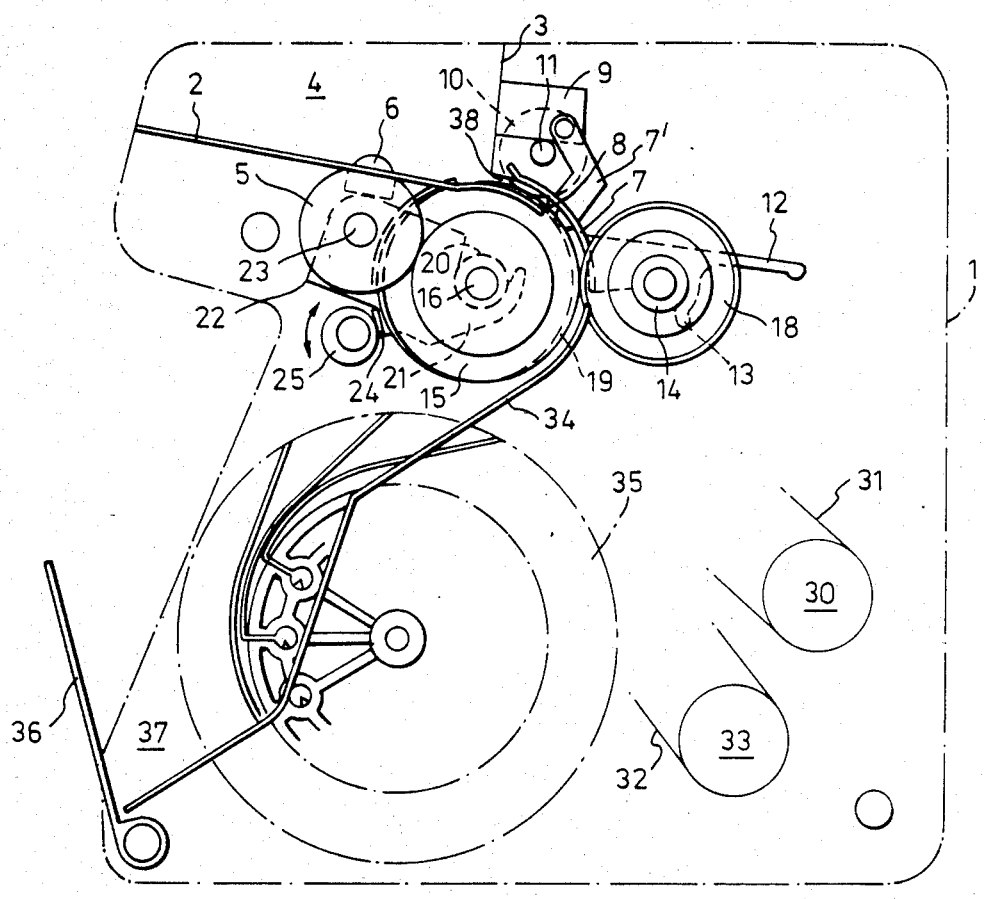
FIG. 1 is a diagrammatic side view of the apparatus.
Figure 2:
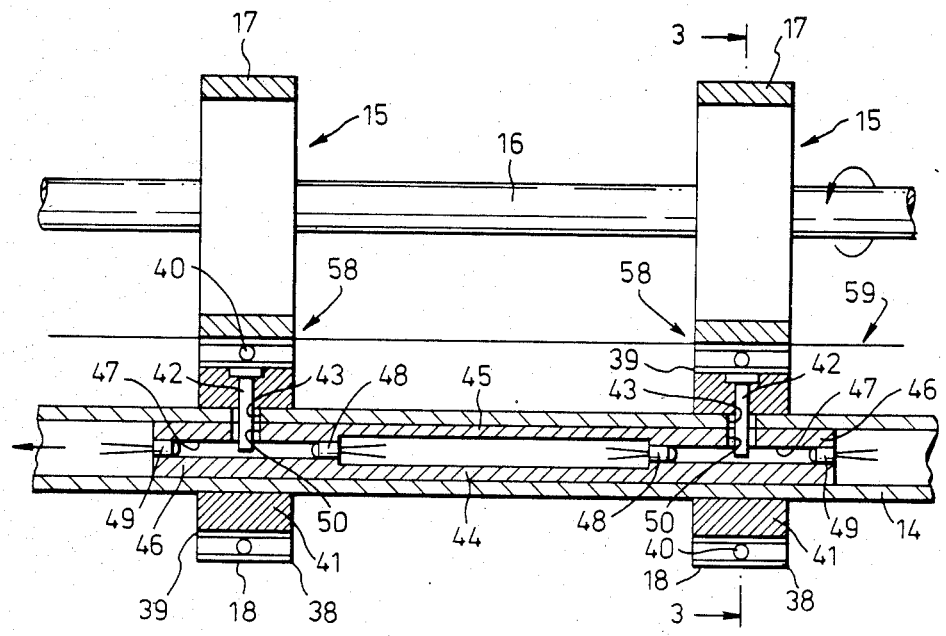
FIG. 2 is a partial cross-section through part of the sheet sensing apparatus with parts omitted for clarity.
Figure 3:
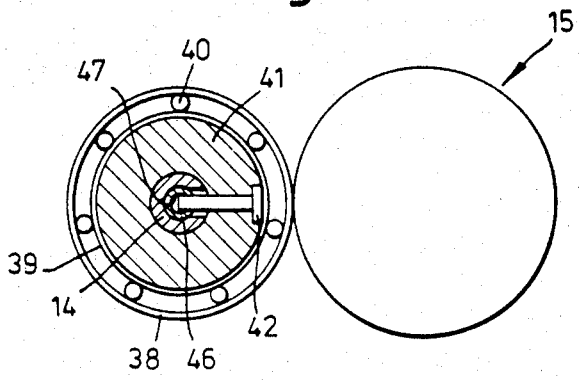
FIG. 3 is a section taken on the line 3—3 in FIG. 2.

The apparatus illustrated in the drawings is a banknote counting apparatus.

The apparatus comprises a metal housing 1 supporting a base plate 2 and an end plate 3 of an input hopper 4. Two conventional picker wheels 5 are rotatably mounted to the housing 1 and have radially outwardly projecting bosses 6 which, as the picker wheels rotate, periodically protrude through slots in the base plate 2.

A guide plate 7 having a curved guide surface 8 is pivotally mounted by an arm 7' to a lug 9 attached to the end plate 3. Two separation rollers 10 (only one shown in the drawings) are rotatably mounted to a shaft 11. A cantilevered arm 12 is connected to the guide plate 7 and includes a spring clip 13. When the guide plate 7 is in its first position shown, the spring clip 13 is located around a stationary shaft 14. If it is desired to cause the plate 7 to pivot away from its first position, the clip 13 is simply unclipped from the shaft 14 and pivoted in an anti-clockwise direction (as seen in FIG. 1) allowing the operator access to the note feed path so that a note jam can be cleared.

A pair of drive rolls 15 are non-rotatably mounted to a drive shaft 16 which is rotatably mounted to the housing 1. Each drive roll 15 has an outer annular portion 17 of rubber. Each drive roll 15 contacts a respective auxiliary roll 18 rotatably mounted on the shaft 14.

A stripper roller 19 is rotatably mounted on a shaft 20 having a larger diameter than the shaft 16 about which it is positioned. The shaft 20 is secured between a pair of arms 21 of a cradle 22. The cradle 22 is rotatably mounted to an auxiliary drive shaft 23 on which the picker wheels 5 are mounted. The cradle 22 has a cam portion 24 which engages a cam 25 rotatably mounted to the housing 1. Manual rotation of the cam 25 forces the stripper roller 19 into engagement with the separation rollers 10.

A drive motor 30 (shown schematically in FIG. 1) continuously drives the drive shaft 16 via a drive belt 31. The connection between the drive belt 31 and the drive shaft 16 has been omitted for clarity. The auxiliary drive shaft 23 is driven via a drive belt 32 by a drive motor 33 and is connected by a drive belt (not shown) to the stripper roller 19.

A guide plate 34 extends from adjacent the nips formed between the drive rolls 15 and auxiliary rolls 18 to a conventional stacker wheel 35 rotatably mounted on the housing 1. The guide plate 34 together with an end plate 36 define an output hopper 37.

The drive rolls 15 and auxiliary rolls 18 define sheet sensing apparatus for detecting the passage of two or more notes simultaneously and for counting banknotes. Alternatively, separate conventional counting means may be used. The drive rollers and auxiliary rolls are spaced apart by a distance less than the width of sheets being counted.

The shaft 14 is hollow, and is non-rotatably supported by the housing 1, and carries the two auxiliary rolls or roller assemblies 18. These are identical in construction and each contacts a respective one of the drive rolls 15.

Each roller assembly 18 comprises a roller bearing having an annular outer race 38, an annular inner race 39 and bearings 40 positioned between the inner and outer races. The bearing is mounted coaxially about the shaft 14 on an annular rubber portion 41. A metal pin 42 abuts the radially inner surface of the inner race 39 and extends through the rubber portion 41 and an aperture 43 in the shaft 14 into the shaft.

A moulded plastic housing 44 is mounted within the shaft 14 and comprises a central tubular portion 45 integral with end portions 46 each of which has a bore 47 communicating with the tubular portion 45. A pair of light emitting diodes 48 are mounted in the inner ends of the bores 47 while a pair of phototransistors 49 are mounted at the outer ends of the bores 47. For clarity, only portions of the connecting wires from the light emitting diodes 48 and the phototransistors 49 have been illustrated. In fact, these wires will pass along and out of the shaft 14 to monitoring circuitry to be described below and to facilitate assembly, all wires extend from the same end of the shaft. Each portion 46 of the housing 44 also has an aperture 50 communicating with the bore 47 and in alignment with the aperture 32. The pins 42 extend through the apertures 50 into the bores 47.

Figure 4:
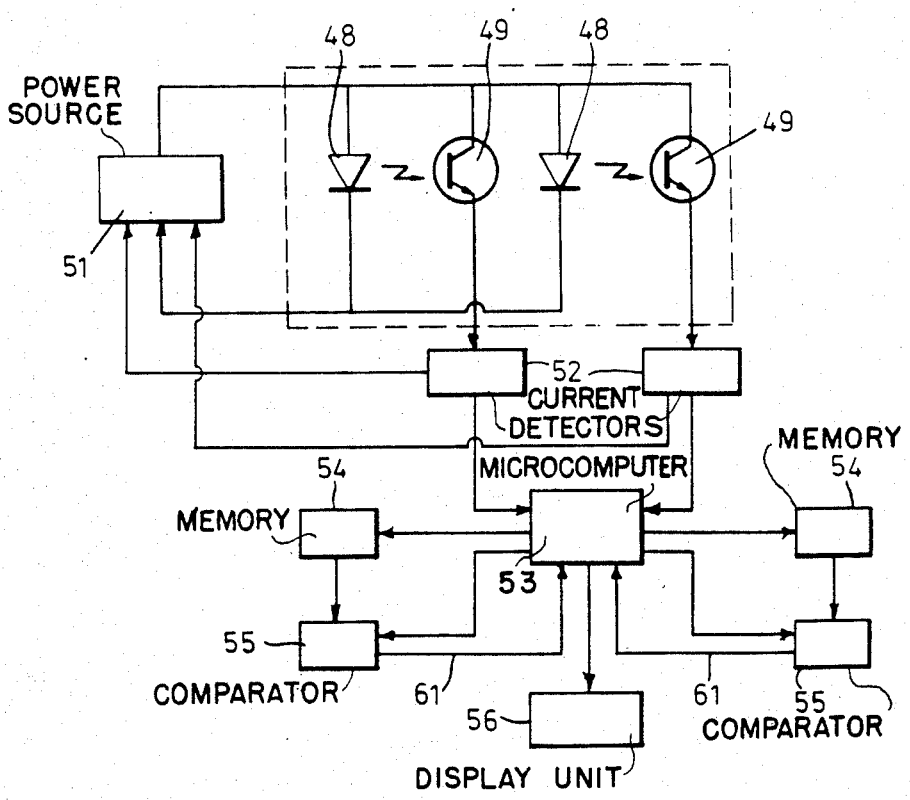
FIG. 4 is a block circuit diagram illustrating circuitry for connection to the sheet sensing apparatus on FIG. 2; and, FIG. 5 illustrates graphically typical output signals from the sensing means.

The circuitry is illustrated in more detail in FIG. 4. FIG. 4 illustrates the two light emitting diodes 48 and the phototransistors 49 each of which is connected to a power source 51. The section of the circuit shown enclosed in dashed lines is that section mounted in the plastic housing 44. The output from each phototransistor 49 is fed via respective current detectors 52 back to the power source 51. The output from the detectors 52 is fed to a microcomputer 53. The microcomputer causes signals from the detectors 52 to be routed to a selected one of a respective pair of a memory 54 and comparator 55. The outputs from the comparators 55 are connected to the microcomputer 53 which is also connected to a conventional counter and error display unit 56.

Figure 5:
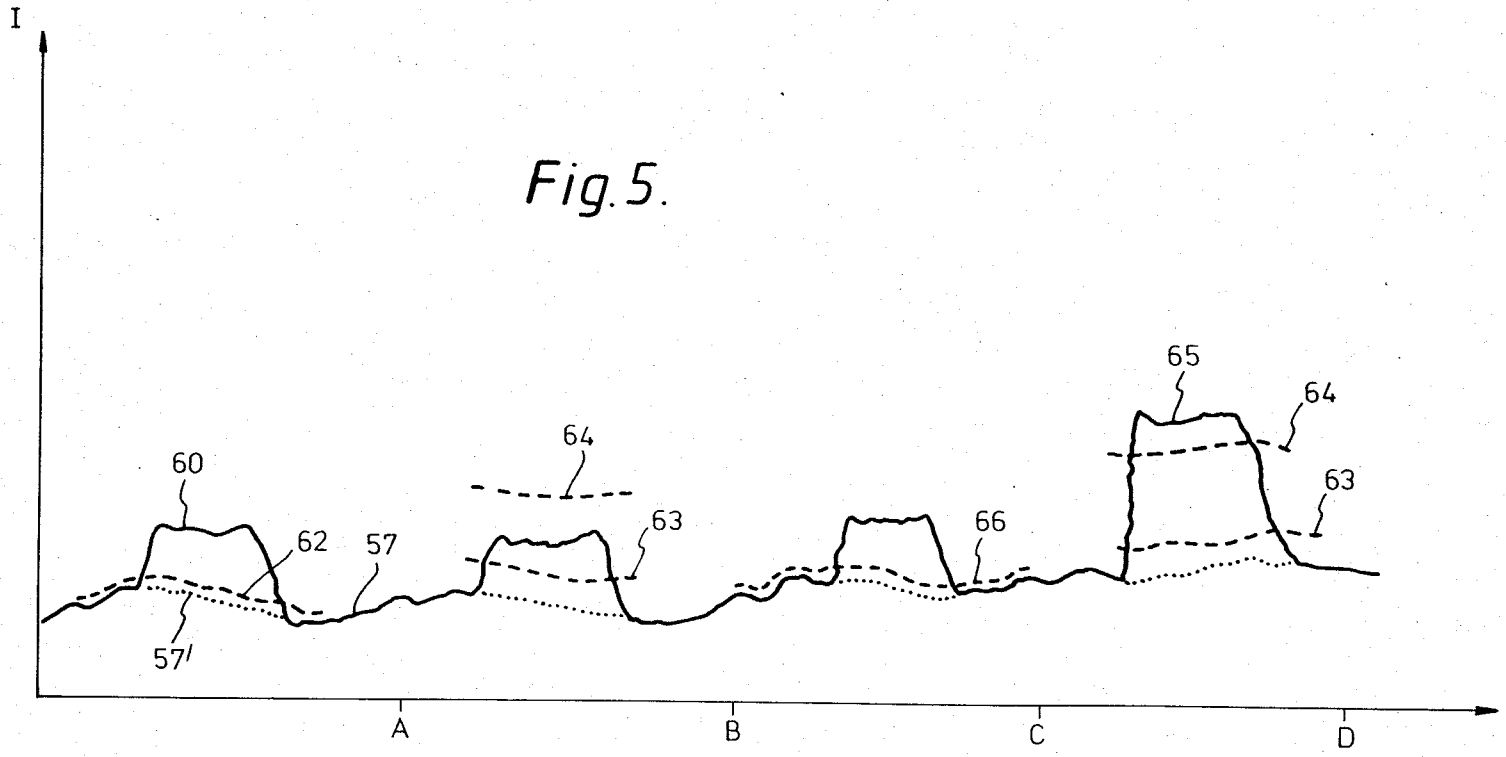

Initially, the drive rolls 15 are rotated and with no sheet present between the driver rolls 15 and roller assemblies 18, any deflection of each roller assembly 18 accompanied by compression of respective resilient portions 41 adjacent the drive rolls 15 will be sensed in a manner to be described at forty equally spaced intervals through one revolution of the roller assemblies 18. Compression of each rubber portion 41 in a radially inward direction will be accompanied by radially inward movement of each pin 42. Each LED 48 continuously emits light which impinges on respective phototransistors 49 causing them normally to be partially switched on. If a pin 42 moves radially inwardly, the pin 42 will increasingly obscure the path of optical rays from the LED's to the phototransistors 49 thus increasing the amount by which the phototransistors 49 are cut off. The output (I) from the phototransistors 49 is fed to the current detectors 52 which provide an output representative of the respective collector current. Under control of the microcomputer 53 these outputs are sampled at forty equally spaced positions around the drive rolls 15 (which will be determined by monitoring a timing disc (not shown) mounted non-rotatably to the shaft 16). The sampled current values are then stored in the respective memories 54 as a guide surface profile. A typical output detected by the current detectors 52 is illustrated by a line 57 in FIG. 5. The forty sampling positions occur between the origin of the graph in FIG. 5 and the position marked A and the guide surface profile comprises that portion of the line 57 up to the position A and including the dotted portion 57'. FIG. 5 illustrates the output from the current detectors 52 over a number of revolutions of the roller assemblies 18 and it will be seen that the guide profile comprising the line 57 and the dotted portions 57' is generally the same in each portion OA, AB, BC and CD.

A stack of banknotes is placed in the input hopper 4. The drive motors 30,33 are actuated so that both the drive shaft 16 and the auxiliary drive shaft 23 rotate. Rotation of the picker wheels 5 causes banknotes at the bottom of the stack to be urged towards a nip 38 between the stripper roller 19 and the separation rollers 10. As the stripper roller 19 rotates in response to the rotation of the auxiliary drive shaft 23, it will engage the adjacent note and carry this note past the guide surface 8 and into the nip 58 formed between the auxiliary rolls 18 and drive rolls 15. The engagement betwen the stripper roller 19 and separation rollers 10 will prevent more than one note being fed by the stripper roller 19. The note will be fed between the drive rolls 15 and the auxiliary rolls 18 due to the continuous rotation of the shaft 16, the note being fed along the guide plate 34 into the stacker wheel 35 which is being rotated by the drive motor 30 and which will stack the note fed in the output hopper 37.

Each LED 48 continuously emits light which impinges on respective phototransistors 49 causing each phototransistor to pass collector current at an initial level. Each pin 42 normally partially obscures the light path. When a sheet 59 is presented to the nip 58 between the drive rolls 15 and the respective roller assemblies 18, the sheet will be taken up and transported through the nip and each rubber portion 41 will be compressed radially inwardly due to pressure exerted from the outer race 38 via the bearings 40 and the inner race 39. This movement will also be accompanied by a radially inward movement of each pin 42, which will thus further obscure the path of optical rays from the LED's 48 to the phototransistors 49 thus further attenuating light transmitted to the transistors 49.

The microcomputer 53 continually samples the output signals from the detectors 52 at the same forty equally spaced intervals but routes these instead to respective comparators 55. An example of a set of output signals caused by the presence of a single note in the nip 58 is illustrated by a line 60 in FIG. 5. It will be seen that part of the line 60 is the same as the line 57 but that over a portion of the sampling region OA it is substantially different. The comparators 55 compare successively the forty values with the corresponding forty values stored in the memory 54 and generate an output on a line 61 (FIG. 4) related to the difference between the values which is fed back to the microcomputer 53. As is to be expected from a banknote with a substantially constant thickness the difference between the signals represented by the line 60 and the corresponding portion 57' of the stored profile is substantially uniform.

The signal on the lines 61 is then compared by the microcomputer 53 with a previously stored threshold which has been set at a relatively low level. This is indicated by a dashed line 62. When this threshold has been exceeded at a number of the sampling positions (normally less than forty since the length of the banknote is generally shorter than the drive wheel circumference) it is assumed that a banknote has passed through the nip. If the presence of a banknote is detected by both phototransistors 49 then the microcomputer 53 causes the unit 56 to increment the count by 1. In addition, the threshold is modified (usually increased) so that it represents the difference between the detector output and the stored profile corresponding to a note having half the thickness of the note detected. Other fractions than one half could also be used. A line 63 illustrates a detector output at the new threshold.

For the remaining banknotes in the hopper 4, this new threshold is used and the steps repeated. Each time a banknote is detected the unit 56 count is incremented by one. FIG. 5 illustrates the detection of single banknotes during successive rotations of the drive rolls 15 in the periods OA, AB, and BC.

In addition, the microcomputer 53 determines whether the detector output signals indicate a thickness greater than a threshold 64 representing one and a half times the thickness of a single note which suggests the passage of two banknotes through the nip 58 simultaneously. In this case, the microcomputer 53 would cause an error message to be displayed by the unit 56 and additionally could cause the drive motors 30,33 to stop. An example of such an output from the detectors 52 is illustrated by a line 65.

With typical materials, it is unlikely that two successive full rotations of the drive rolls 15 and auxiliary rolls 18 will cause the phototransistors 49 to provide exactly similar outputs due to dirt coming off the notes. Thus, for example, even when no note is present in the nip 58, a subsequent output sensed by the current detectors 52 might have the form shown by a line 66 in FIG. 5. After sampling and comparison under the control of the microcomputer 53, however, the microcomputer 53 would determine that the difference between the detector output and the stored profile did not exceed the threshold and thus the microcomputer 53 would not consider that the passage of a note had occurred.

Additionally, over a period of time, the output from the detectors 52 may change significantly, that is by an amount similar to that which would be expected from the passage of a note. In order that the apparatus can still function, the microcomputer 53 causes a new profile to be stored by the memories 54 instead of the previously stored profile 57, 57' just before a new stack of banknotes are counted. In this way, the threshold which must be initially determined by the microcomputer 53 is automatically corrected for changes in profile.

In some cases, a folded note may be passed through the apparatus in which case the microcomputer 53 will pass signals to one of the comparators 55 which may indicate the presence of a note 59 while the signals passed to the other comparator 55 will suggest that no note is present. The microcomputer 53 can detect from the signals passed to it along the lines 61 that they represent different differences and in such a case can cause the unit 56 to display an appropriate error message.

The microcomputer 53 can also be programmed to be able to detect half notes as well as folded notes, and notes which have been fed in a skewed manner. In addition, one important feature is that the length of notes fed can be determined. Where the output from the phototransistors 49 is monitored at eight or more positions a progressively more accurate determination of the length of a note being fed can be achieved. This is particularly useful since it provides a non-time dependent method of measuring note length.

We claim:

1. A method of sensing the passage of sheets through a nip between a pair of guide surfaces by sensing with sensing means the relative deflection between the guide surfaces in response to the presence of a sheet in the nip, said sensing means being adapted to generate an output signal related to said sensed deflection, the method comprising:

(a) monitoring said output signal of said sensing means at a number of sampling times when no sheet is present, to generate and store a guide surface profile;

(b) monitoring subsequent output signals of said sensing means at a number of sampling times to generate a test profile;

(c) comparing said test profile with said stored profile; and (d) sensing the presence of a sheet in said nip only when there is a substantially uniform difference between the stored guide profile and said test profile over a plurality of said sampling times.

2. A method according to claim 1, wherein step (a) is carried out after the passage of each sheet.

3. A method according to claim 1 or claim 2, wherein said output signal of said sensing means is monitored at a number of equal spatial intervals along said guide surfaces.

4. A method according to claim 1, wherein the presence of a sheet in said nip is sensed when the difference between said stored and test profiles exceeds a threshold.

5. Apparatus for sensing the passage of sheets through a nip, comprising:

a pair of guide surfaces defining said nip; p1 means adapted to pass sheets through said nip;

sensing means adapted to sense the deflection of one of said guide surfaces relative to the other at a number of sampling times and to generate an output signal related to said sensed deflection;

monitoring means adapted to monitor said output signal of said sensing means and to store a guide surface profile corresponding to said sensing means output signal when no sheet is present;

comparison means adapted to compare subsequent test profiles generated by said monitoring means with said stored profile; and detection means adapted to detect the presence of a sheet in said nip only when there is a substantially uniform difference between said stored and test profiles over a plurality of said sampling times.

6. Banknote feeding apparatus for feeding banknotes through a nip, comprising:

a pair of guide surfaces defining said nip;

means adapted to pass banknotes through said nip;

sensing means adapted to sense the deflection of one of said guide surfaces relative to the other at a number of sampling times and to generate an output signal related to said sensed deflection;

monitoring means adapted to monitor said output signal of said sensing means and to store a guide surface profile corresponding to said sensing means output signal when no banknote is present;

comparison means adapted to compare subsequent test profiles generated by said monitoring means with said stored profile; and detection means adapted to detect the presence of a banknote in said nip only when there is a substantially uniform difference between said stored and test profiles over a plurality of said sampling times.

* * * * *